United States Patent [19]

Ames

[11] 3,973,695

[45] Aug. 10, 1976

[54] DISPENSER FOR MOIST TISSUES

[76] Inventor: John B. Ames, 100 Valley Road, Marion, Ala. 36756

[22] Filed: Oct. 31, 1975

[21] Appl. No.: 627,747

[52] U.S. Cl. ..... 221/63
[51] Int. Cl.[2] ..... B65H 1/00
[58] Field of Search ..... 221/26, 63, 47–55

[56] References Cited

UNITED STATES PATENTS

| | | | |
|---|---|---|---|
| 3,269,593 | 8/1966 | Lodewick et al. | 221/63 |
| 3,780,908 | 12/1973 | Fitzpatrick et al. | 221/48 |
| 3,843,017 | 10/1974 | Harrison | 221/63 |

*Primary Examiner*—Allen N. Knowles
*Attorney, Agent, or Firm*—Beall & Jeffery

[57] ABSTRACT

A dispensing container for dispensing tissues one at a time from a web of perforated tissue material such as a web of premoistened, perforated towels. A cap is removably secured to the container body and a dispensing outlet is formed in the cap, with the outlet comprising a generally enlarged portion through which the tip of the leading tissue of the web can be passed, a groove portion extending from one end of said enlarged portion, and a generally circular portion at the opposite end of said groove. The generally circular portion of said outlet functions to apply tension to the web when the web is pulled from the container, the tension causing the leading tissue to separate at the perforation from the next tissue and leave exposed the tip of the next tissue to facilitate the next dispensing operation.

9 Claims, 6 Drawing Figures

DISPENSER FOR MOIST TISSUES

BACKGROUND OF THE INVENTION

The present invention relates as indicated to a dispenser for moist tissues, and relates more particularly to a dispenser in which a treated perforated tissue web is placed within the dispenser and in which a single tissue is dispensed by severing the forward-most, partially exposed tissue from the remainder of the web.

Moist tissues or towelettes of the type here concerned are becoming increasingly popular for the purpose of providing a means by which suitable cleansing can be effected without access to normal cleaning facilities, such as bathrooms or the like. Moist tissues are particularly useful during periods of travel where the occupants of the vehicle are without cleaning facilities between stops.

As previously indicated, the perforated web of tissues is disposed in the container, and the dispensing operation must be such that a single tissue can be separated from the web, and such operation consistently repeated. Accordingly, a friction dispensing outlet of some type is required, that is, an outlet in which the free dispensing of the tissue is restricted by frictional resistance encountered by the web through the dispensing outlet. As well understood by those in the art, if the frictional resistance is not sufficient, the web will be pulled unimpeded or "roped" through the dispensing outlet, resulting in the dispensing of several individual tissues at a time, rather than a single tissue as intended. On the other hand, if the frictional resistance at the dispensing opening is excessivly large, the leading tissue will tend to separate prematurely above the perforation line with the succeeding tissue, with the disadvantageous results from such premature tearing being the dispensing of only a partial tissue or the tearing of the leading tissue at or closely adjacent the dispensing opening, thereby making it difficult to extract the leading end of the tissue for further dispensing operations. Optimum dispensing conditions occur when the leading tissue is separated from the web at a predetermined level of friction resistance so that the leading end of the succeeding tissue is exposed exteriorly of the dispensing outlet so as to be readily grasped by the user when the next dispensing occurs.

The problems referred to above in the dispensing of moist tissues are well recognized in the art, and various solutions have been proposed. For example, in U.S. Pat. No. 3,749,296, to Thomas S. Harrison, granted July 31, 1973, the dispensing outlet is in the form of a cross provided by intersecting slits, with the slits being shaped to provide the desired frictional resistance to the leading tissue during the dispensing operation. However, this proposed solution has the disadvantage that if premature tearing occurs, it is difficult for the user to reach into the interior of the container through the slits to grasp and extract the leading end of the tissue.

A further proposed solution to the noted problems is disclosed in U.S. Pat. No. 3,843,017, issued Oct. 22, 1974 to Thomas S. Harrison, which discloses a container for dispensing moist tissues in which the dispensing outlet is defined by a movable flap which totally or partially covers an opening formed in the lid of the receptacle so as to define with such opening an outlet through the tissue can be pulled for sequential dispensing of tissue from the web. One form of the invention provides a relatively small, fixed dispensing outlet, and has the disadvantage that such fixed opening cannot adequately accommodate varying widths and bulk of the web material. Although the single opening may dispense satisfactorily a web having a particular width and weight, variations in the web width and material reduce the effectiveness of the fixed opening to properly tension the web.

SUMMARY OF THE INVENTION

With the above in mind, the principal object of the present invention is to provide a dispenser in which a dispensing outlet or opening is formed in the cap for the container, with the outlet being constructed to provide the desired tension to the web during the dispensing operation so that the leading tissue is separated along the perforations, leaving the tip of the succeeding tissue outwardly of the cap to facilitate the next dispensing operation. The dispensing outlet is particularly characterized by including a relatively enlarged portion, triangular in the form shown, one end of which communicates with a slot which in turn communicates at its opposite end with a generally circular opening. The enlarged portion of the outlet permits the first sheet of the web to be easily threaded therethrough by the user so as to expose the first sheet for extraction from the web. The actual separation along the perforations occurs in the generally circular opening and in the slotted portion of the opening adjacent such circular opening, by means of a gentle pulling action of the tissues upwardly and toward such circular opening.

Another object of the invention is to provide a dispensing outlet which can accommodate webs of material having varying width and bulk characteristics without reducing the effectiveness of the dispensing through the outlet. The portion of the elongated slot adjacent the circular portion of the outlet receives surplus web material not able to be satisfactorily accommodated in the circular portion of the opening whereby substantially uniform tension can be applied to the web despite variations in web width and bulk.

A further feature of the present invention resides in a specially formed lid for covering the dispensing outlet when not in use, thereby minimizing evaporation of the moist tissues within the dispensing container. In accordance with the invention, a recess for the lid is formed in the cap and the lid is pivotally connected to the cap for movement between an open position exposing the dispensing outlet and a closed position in said recess and covering the outlet. When in such closed position, the top of the lid is flush with the top of the cap, with the leading end of the lid extending slightly beyond the periphery of the cap to facilitate grasping the lid for movement to an open position.

A still further object of the invention is to provide a dispensing container which can be manufactured relatively inexpensively and which can be easily used by the consumer. The cap of the container can be molded in one operation and no post-molding assembly is required. In use, once the tip of the leading tissue is threaded through the outlet, the individual tissues can be separated one at a time by applying substantially uniform tension to the web.

These and other objects of the invention will become apparent from the description which follows in particular reference to the application drawing.

BRIEF DESCRIPTION OF THE APPLICATION DRAWING

In the application drawing,

FIG. 5 is a fragmentary side elevational view showing the manner in which the leading tissue is severed from the web of tissues principally in the circular portion of the dispensing outlet.

DETAILED DESCRIPTION OF THE PREFERRED EMBODIMENT

Figure 1:
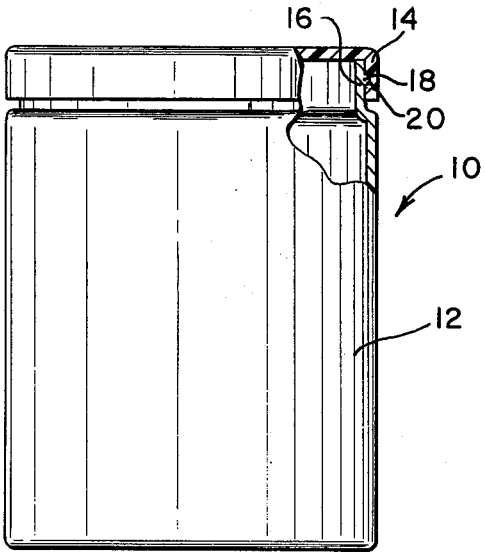
FIG. 1 is a side elevational view, partially fragmented, showing a diameter container constructed in accordance with the present invention.

Referring now in more detail to the application drawing, wherein like parts are indicated by like reference numerals, the dispensing container constructed in accordance with the present invention is generally indicated at 10 and comprises a body 12 and a cap 14. The body 12 is formed with a reduced diameter neck portion 16 the outer periphery of which is formed with an annular recess 20 adapted to receive the bead 18 when the cap is snapped down over the neck 16. A frictional fitting is thereby provided between the cap and the body, whereby the cap may be easily manually removed for supplying additional webs to the container. Although a snap fit has been illustrated for the cap and the body, it will be understood that the cap and body may be provided with screw threads or other suitable securing means for removably retaining the cap on the body. It will also be understood that the body and cap, although shown circular in the application drawings, can be square, oval, or any desired shape and is of sufficient height and volume to receive the web of tissues therein.

Figure 4:
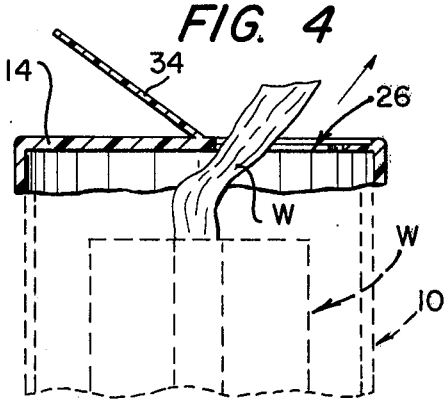
FIG. 4 is a fragmentary view showing the manner in which the leading tissue is threaded upwardly through the enlarged part of the dispensing outlet.
Figure 5:
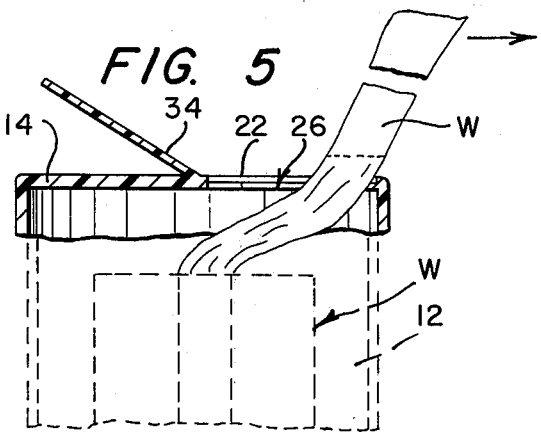
FIG. 5 is a fragmentary side elevational view showinig the manner in which the leading tissue is threaded upwardly through the enlarged part of the dispensing outlet.
Figure 6:
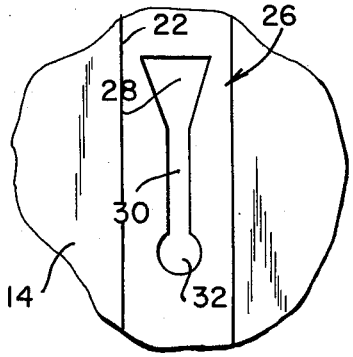
FIG. 6 is a fragmentary, enlarged view more clearly showing the dispensing outlet.

Referring to FIGS. 4 and 5, the web of tissues is indicated in dash lines at W and in the form shown the individual tissues are dispensed from the inside of the roll rather than the outside, although either arrangement is satisfactory. The web of tissues is preferably premoistened prior to placement in the container 10, although it will be understood that a moisturizing liquid can be contained within the body 12 for contact with the web W.

Figure 2:
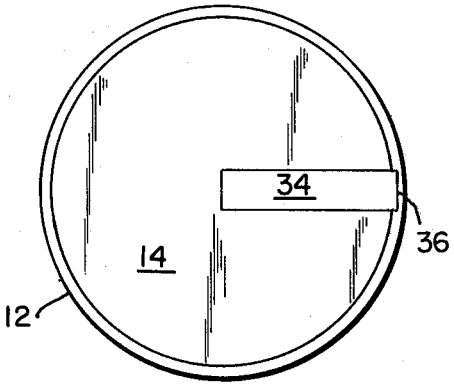
FIG. 2 is a top plan view of FIG. 1, showing the lid for the dispensing outlet in a closed position.
Figure 3:
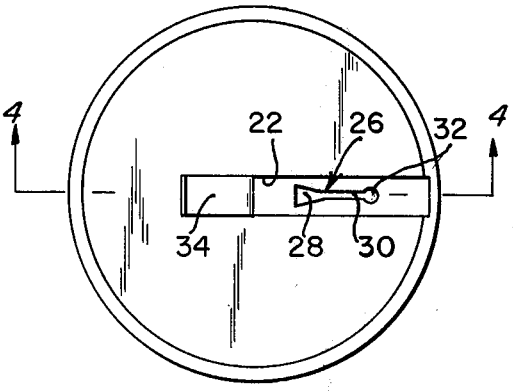
FIG. 3 is a view similar to FIG. 2, with the lid being shown in an open position exposing the dispensing outlet.

The present invention relates to the dispensing outlet formed in the cap 14, and reference is made to FIGS. 3–6. The cap is formed with a recess 22 in the upper surface thereof, and a dispensing outlet generally indicated at 26 is formed in the recess through the remaining thickness of the cap. The dispensing outlet 26 includes an enlarged portion 28, triangular as shown, a slot or groove portion 30, and a generally circular end portion 32. A lid 34 is integral with and hinged to the cap at the end of the recess 24, preferably by means of a "living hinge," with the thickness of the lid 34 coinciding with the depth of the recess 22 whereby the lid, when closed, is flush with the top surface of the cap 14, with the lid in such position covering the dispensing outlet 26. As shown in FIG. 2, the lid 34 preferably extends slightly beyond the periphery of the cap 14, as shown at 36, to provide a tab by means of which the lid can be raised to expose the dispensing outlet. The entire construction of the cap 14 and the body 12 can be molded from a suitable plastic material, with neither the material nor the molding techniques forming a part of the present invention. The cap 14 can be molded as one piece and no part-molding operations or assembly is required, whereby manufacturing costs are minimized.

As noted, the web W is provided in roll form, with the roll varying in width, for example, from 5 to 12 inches depending upon the size of the container, with the web being perforated at spaced increments along the length of the roll. The spacing between perforations will vary depending upon the width of the roll, with perforations every 6 to 9 inches being typical. The tissue is preferably comprised of non-woven fabric or paper material having the necessary web strength characteristics to satisfactorily absorb the tension applied to the web during the dispensing operation in which the leading tissue is separated along the perforations from the succeeding tissue. Again, the present invention is not directed to the particular material used, and in this regard it should be noted that the dispensing outlet of the present invention works equally well with wet or dry tissues. A non-woven fabric can be used and special papers are also commercially available, with paper having a substantial cost advantage over non-woven fabric.

The manner in which the tissues are dispensed from the web W through the dispensing outlet 26 is as follows. The container is normally supplied to the retailer with the lid 34 in a closed position covering the recess 22 and the dispensing outlet, and the innermost, leading tissue of the web, assuming the tissues are dispensed from the inside of the roll rather than the outside, is positioned just below the dispensing outlet 26. When it is desired to dispense a tissue from the container, the consumer moves the lid 34 to an open position as shown in FIGS. 4–5, and grasps and pulls the tip of the leading tissue through the enlarged portion 28 of the dispensing outlet, with such enlarged portion being sufficient in area to enhance grasping of the tissue without difficulty, a problem encountered in certain prior art dispensing containers. The cap 14 can be temporarily removed and the tip of the tissue threaded through the enlarged portion 28 in the event the tissue cannot be grasped from the exterior of the cap.

After pulling or threading the lead end of the tissue through the enlarged portion 28 of the dispensing outlet, the tissue is pulled upwardly and outwardly so that the tissue passes through the slot 30 toward and into the circular portion 32 of the outlet. At this point, the tissue is located entirely within the circular portion 32 and the adjacent end of the slot 30 of the dispensing outlet, and when the leading tissue is completely exterior of the container, as can be visually seen from the presence of the perforations which separate the tissues, the leading tissue is pulled radially outwardly of the container as shown in FIG. 5 whereby the leading tissue is separated at the perforations from the next tissue. The leading end of the next tissue remains exposed exteriorly of the dispensing outlet whereby the dispensing of the next tissues can be effected simply by pulling the next tissue upwardly and outwardly as described. Between dispensing operations, the lid 34 is preferably closed to prevent evaporation from the moist tissues, with the length of tissue extending through the dispensing outlet not being sufficient in quantity to interfere with the closing of the lid. The recess 22 and lid 34 are preferably dimensioned so as to provide a fairly tight fit when the lid is closed, with the tab 36 at the forward end of the lid facilitating lifting of the same prior to the next dispensing operation. If desired, the recess 22 and lid 34 may be constructed so as to provide a more positive interfitting so as to move positively maintain the lid in its closed position.

Highly satisfactory dispensing is achieved by virtue of the dispensing outlet in accordance with the present invention. Due to the shape of the dispensing outlet, particularly the enlarged circular opening and the slot adjacent thereto, it is possible to repeatedly feed and tear off the leading tissue by applying uniform tension to the tissue through the dispensing outlet. As previously noted, too little tension or frictional resistance at the dispensing outlet results in "roping" of the web so that more than one tissue is dispensed at one time. On the other hand, if the tension or frictional resistance is excessive, the tension in the tissue results in premature tearing of the lead tissue either above the line of perforations or when the perforations have not yet reached the dispensing outlet. The result in either event is undesirable and adversely effects the proper dispensing of the next tissue.

An important factor in accordance with the improved results achieved by the present invention is the relationship between the size of the circular portion 32 of the dispensing outlet and the perforations in the web W. The spacing and size of the perforations directly effect the amount of tension required to be applied to the leading tissue to achieve separation of the same from the succeeding tissue, as do the area of the circular portion 32 of the dispensing outlet and the quantity of tissue material pulled therethrough. The quantity of material depends upon the width of the web W, and the diameter of the circular portion 32 of the outlet should be generally proportional to the width of the web W. This can be easily effected during manufacturing by providing a cap having a dispensing outlet specifically adapted to dispense tissues from a web having a particular width to fit the container. However, a significant advantage of the present invention resides in the ability of the dispensing outlet to properly tension the web despite variations in web width and bulk. Excess material not contained in the circular portion 32 of the outlet 26 is allowed to spill over into the slot or groove 30, with the tension in the web during the tearing or separation, however, being controlled principally by the material in the portion 32. Once the tearing along the perforations is initiated response to the pulling of the tissue upwardly and outwardly, the tearing will continue along the perforations of the material located in the groove. As will be readily understood by those skilled in the art, with webs of greater width or bulk, the amount of material spilling over into the groove will be greater, without, however, adversely affecting the substantially uniform pressure needed to effect separation of the tissues.

Also significant is the dimensional relationship of the slot 30 to the circular portion 32 of the outlet. Where the web width is 5–8 inches, a circular opening of ⅛ inch provides excellent dispensing, and the width of the slot 30 is preferably one-half the diameter of the circular opening, or 1/16 inch. This relationship serves to direct the tissue into the circular opening and to permit any excess material to remain in the slot. After substantial experimentation, the arrangement of the slot and circular opening was found to permit repeated dispensing of the tissues with uniform levels of tension applied to the leading tissue. At least 50% and preferably up to 75% of the tissue should be positioned in the circular opening 32 during dispensing, and lesser amounts are indicative of the need to use a larger opening and slot for the particular material dispensed. This can be readily accommodated by changing the cap to one in which the dispensing outlet has a larger slot and circular opening.

It will thus be seen that the objectives of the invention have been achieved. By virtue of the novel shape of the dispensing outlet, if is possible to repeatedly dispense individual tissues from a web of tissues by applying a constant tension on the leading tissue as it is pulled upwardly through the dispensing outlet. The tissue is pulled both upwardly and radially outwardly and the leading tissue is separated at the perforation line, leaving an exposed portion of the next tissue to facilitate the next dispensing operation. Between dispensing operations, the lid can be moved to a closed position thereby covering the exposed tissue and preventing evaporation of the tissues in the container.

I claim:

1. A dispensing container for dispensing tissues one at a time from a web of perforated tissue material, comprising a. a body for containing said web, said body having an open upper end, b. a cap for said body, c. means formed on said cap and said body for removably securing said cap to said body, and d. a dispensing outlet formed in said cap, said outlet comprising a generally enlarged portion through which the tip of the leading tissue of the web can be passed to expose such tip exteriorly of the upper surface of the cap, a groove portion extending from one end of said enlarged portion, and a generally circular portion at the opposite end of said groove, said generally circular portion of said outlet functioning to apply tension to the web when the web is pulled from the container, the tension causing the leading tissue to separate at the perforations from the next tissue, with the tension applied to the web by said generally circular portion of said outlet being such that the leading tissues is separated at the perforations so as to leave the tip of the next tissue exteriorly of the cap to facilitate the next dispensing operation.

2. The dispensing container of claim 1 wherein said cap has integrally formed therewith a lid hinged to the cap, said lid being movable between an open position exposing the dispensing outlet and a closed position fully covering said dispensing outlet.

3. The dispensing container of claim 2 wherein the upper surface of said cap is formed with a recess, the depth of said recess corresponding to the thickness of said lid whereby said lid when closed is flush with said upper surface of said cap, said dispensing outlet being formed through said cap in the region of said recess.

4. The dispensing container of claim 1 wherein said enlarged portion of said dispensing outlet is generally triangular in shape, and said groove extends from one of the apices of said triangle.

5. The dispensing container of claim 1 wherein said container includes a reduced diameter neck portion over which said cap extends, said cap includes a planar top portion and an annular side wall portion extending normal to said top portion, and wherein said means for removably securing said cap to said body comprises a projection extending laterally from the outer surface of said neck portion of said body, said projection engaging an annular groove formed in the interior surface of said side wall of said cap, whereby said cap is frictionally retained on said body.

6. The dispensing container of claim 2 wherein said lid is integrally formed with said cap and is hinged thereto by means of a "living" hinge, with the width of said lid and said recess being dimensioned so that said lid tightly frictionally engages the walls of said recess when closed, with the length of said lid being such that the leading end thereof extends over the edge of said cap to facilitate lifting of said lid prior to the dispensing operation.

7. The dispensing container of claim 1 wherein the width of said groove is approximately one-half the diameter of said circular portion of said outlet.

8. The dispensing container of claim 7 wherein said circular portion is ⅛ inch in diameter and the width of said groove is 1/16 inch.

9. The dispensing container of claim 7 wherein 50–75% of the leading tissue of the web is disposed in said circular opening during dispensing, with the remainder being in the end of the groove adjacent said circular opening.

* * * * *